US005758517A

United States Patent [19]

Freilich

[11] Patent Number: 5,758,517

[45] Date of Patent: Jun. 2, 1998

[54] METHOD AND APPARATUS TO SET PRECIOUS STONES WITHOUT HAMMERING

[75] Inventor: Joseph Freilich, Old Westbury, N.Y.

[73] Assignee: M. Fabrikant & Sons, Ltd., New York, N.Y.

[21] Appl. No.: 685,187

[22] Filed: Jul. 18, 1996

[51] Int. Cl.[6] ..... A44C 17/02

[52] U.S. Cl. ..... 63/28; 63/26; 29/10

[58] Field of Search ..... 63/26, 27, 30, 63/31, 15, 28; 29/10

[56] References Cited

U.S. PATENT DOCUMENTS 4,630,346 12/1986 Singer ..... 29/10 X 5,232,752 8/1993 Crespi et al. ..... 63/26 X 5,419,159 5/1995 Muller ..... 63/28

5,426,836 6/1995 Lynch ..... 29/10

5,431,028 7/1995 Lampert et al. ..... 63/26 X

*Primary Examiner*—Kien T. Nguyen

*Attorney, Agent, or Firm*—Levisohn, Lerner, Berger & Langsam

[57] ABSTRACT

An jewelry article includes a metal portion and stones attached thereto. The metal portion has ornamental surfaces with a fragile structure, and the stones set fixedly directly to the ornamental surfaces without hammering or deforming of the ornamental surfaces.

4 Claims, 4 Drawing Sheets

FIG. 6
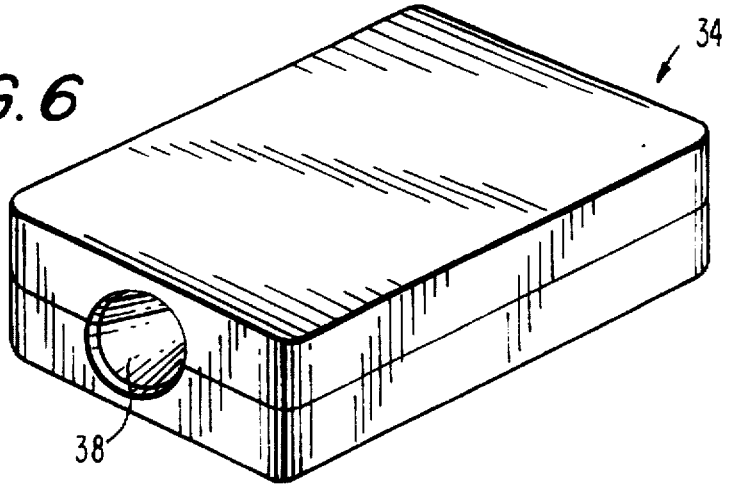
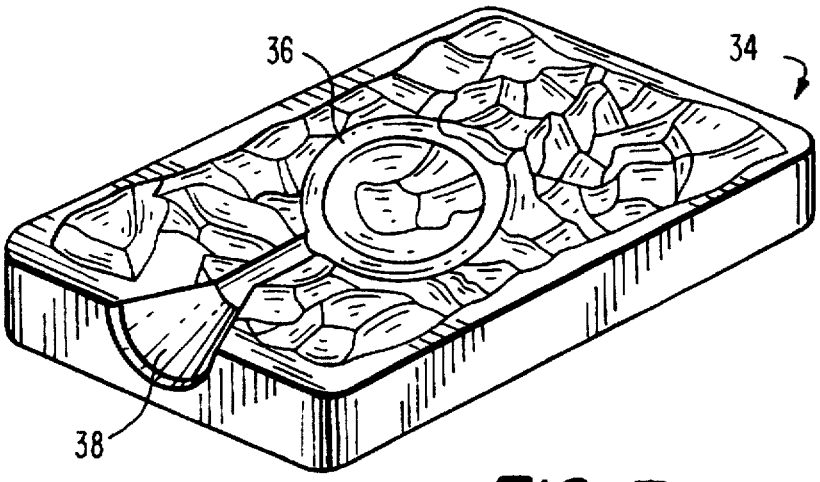
FIG. 7

METHOD AND APPARATUS TO SET PRECIOUS STONES WITHOUT HAMMERING

FIELD OF THE INVENTION

The present invention is an improved and new method for setting precious stones in jewelry. This improved method increases the design potential in jewelry with precious stones without the need of hammering as part of the setting process. With the hammering element eliminated, the designer has greater freedom to be creative with the use of precious stones. In addition, the cost of setting the precious stones is significantly less to the jewelry designer/manufacturer. Thus, this new method promotes a more creative and attractive appearance for the jewelry piece.

BACKGROUND OF THE INVENTION

The process of manufacturing jewelry is a time-demanding, costly, and lengthy process. The first step begins when the jeweler has an idea for a new design for jewelry. The designer then uses wax or another material to create a new model. After the new model has been created, this new wax structure becomes a "jewelry model" which is then used to make a metal jewelry model. From that model, a rubber mold is formed which is used to "shoot" a wax model. That model is used to cast jewelry using the lost wax process.

Precious or semi-precious stones are often incorporated in jewelry designs. A mechanical holding action keeps the stones attached to the metal jewelry. Such attachment is facilitated by imparting some mechanical force to the metal holding the stones. For single stones set in jewelry, prongs are often used, whereas for rows of stones, a channel set method (FIGS. 1 and 2) is often employed. In the channel set method, the stones 10 are set between opposite thin walls 12 and the tops 14 or side of the walls 12 are hammered so as to hold the stones 10. After the hammering is completed, the thin walls 12 are polished to eliminate the imperfections due to the hammering. When finished, the row of stones 10 appear to be held between stripes of precious metal. In the above method, the stones are set in the jewelry after the metal portion of the jewelry is cast or formed. Even though they are effective in holding the precious stones 10, the above method restricts the artistic freedom of the designer.

FIG. 3 shows a prior fragile observable ornamental rope design 16 with a groove or channel 18 formed in the wall 20 below the rope design in which baguettes 10 are hand set into the metal. The metal walls 20 are hammered to hold the baguettes 10 in place. Additionally, some wax set-processing has been used to form such channels in wax with the stones set between the channels in wax such that the stones are initially set in place between the channels which then is hammered to more securely set the stones. In such wax set method, the diamonds or stones are set in the wax model between the thin walls, and the stones stay in place as the liquid gold fills the cavity formed in the plaster of paris cylinder used in the lost wax process as the wax melts. Thereafter, the thins walls are deformed as by hammering to firmly set the stones in place. After such hammering, the top of the thin walls are polished to form the thin "stripes" of the prior art. This allows quicker setting methods, without the need to set each stone one-by-one in the metal or finished metal piece.

No one has previously combined a non-channel structure, as in FIGS. 1 and 2 with the stones set directly between the walls such that no further hammering is required, thus enabling observable ornamental fragile designs to be used which directly hold the stones in place with the wax set process.

SUMMARY OF THE INVENTION

An object of this invention is, therefore, to provide an improved method of setting precious stones in jewelry without the need for hammering.

Another object of this invention is to provide a new technique to improve the design quality of jewelry by discarding the limitations of the hammering method.

Still another object of this invention is to eliminate the need for thin walls between which precious stones are held.

Another object of this invention is to lessen the high cost of labor involved in setting stones in jewelry.

The present invention achieves its purpose by eliminating the need to hammer or deform the metal when setting stones in jewelry. This new method eliminates the need for thin walls in the design to hold precious stones. The prior art need for thin walls restricts the designer's freedom to be creative and by polishing such thin walls, such designs suffer from an uniformity of thin stripes adjacent rows to rows of stones, whether round, baguette, or any other symmetrical cut. Instead, during the wax-set-process, precious stones are set in the fragile structure of the design without needing hammering.

The prior art shows wax setting diamonds between thin walls, which thereafter are deformed and polished to hold the stones. Such wax setting of diamonds between thin walls eliminates hand setting of the diamonds. The prior art also shows ornamental fragile designs such as rope, filigree which has only had stones manually set between thin walls adjacent the fragile designs. The inventor is the first to combine wax setting diamonds in ornamental designs which by themselves hold the stones without thin walls and without deformation. The wax material facilitates setting the stones in the ring because of the malleability of wax. By providing a method and apparatus to allow these designs to directly abut the stones without hammering to hold the stones in place greatly expands the range and structural combination of metal and stones.

BRIEF DESCRIPTION OF THE DRAWINGS

FIG. 6 is a perspective view of a rubber mold with a cavity in the shape of a model inside the mold.

FIG. 7 is a perspective view of the lower half of a rubber mold cut in half showing where a cavity is formed to form a wax model.

DETAILED DESCRIPTION OF THE INVENTION

Figure 1:
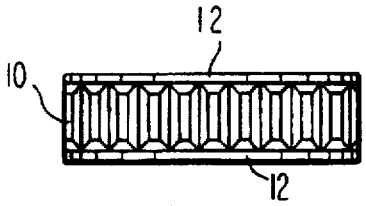
FIG. 1 PRIOR ART
FIG. 1 is iew of a prior art ring with channel set stones.
Figure 2:
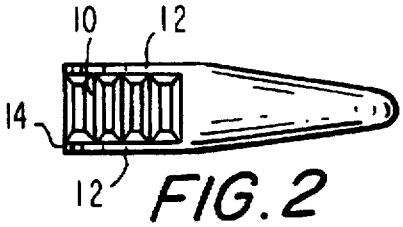
FIG. 2 PRIOR ART
FIG. 2 is a side view of the ring of FIG. 1 with the stones set in a channel where the thin walls of the channel are hammered in to hold the stones.
Figure 3:
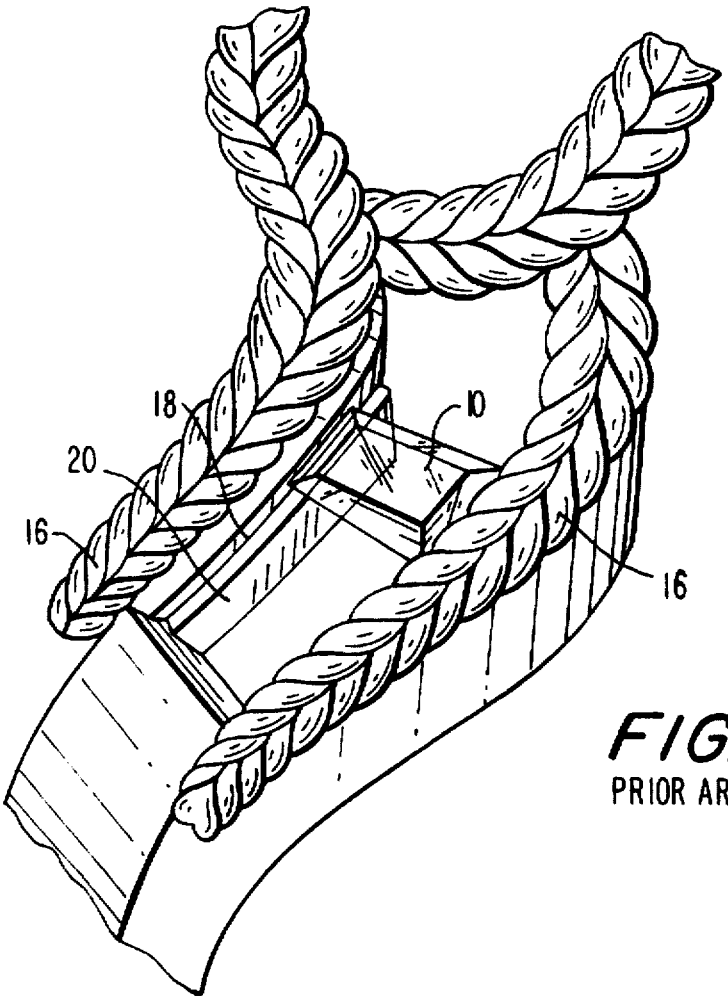
FIG. 3 PRIOR ART
FIG. 3 is a perspective view of the prior art showing a baguette hand set in a channel with a rope design above the channel.
Figure 4:
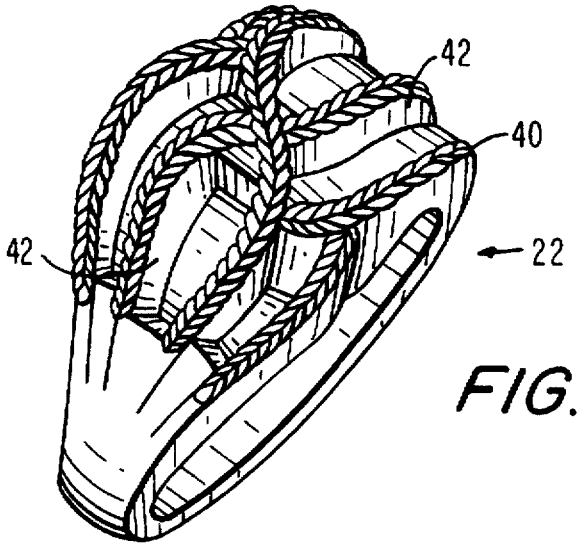
FIG. 4 is a perspective view of a model of an ornamental rope design ring shown without precious stones for a ring especially susceptible to being used in the present invention both as a metal and wax model.

First, the jewelry designer makes a wax model of a jewelry design. The wax model 22 may have the appearance of the ring design of FIG. 4. After the wax model 22 has been made, according to FIG. 8, one side of a sprue 24 is attached to the wax model 22, and the other side of the sprue 24 is attached to a tree 26. The apparatus (the wax model attached to the sprue which is attached to the tree) is placed in a metal cylinder 28. Plaster of paris is poured into the metal cylinder 28 and hardens. The cylinder 28 filled with the hardened plaster of paris has a hole 30 on the bottom surface 32 which marks the tree 26.

Hot, metal liquid is poured into this hole 30. The hot metal flows through the tree 26, the sprue 24, and into the wax model 22 inside the plaster of paris and melts the tree, the sprue and the wax model. The hot metal cools, and the plaster of paris is crumbled and removed from the metal model formed inside the plaster of paris. The metal model serves as a permanent record of the jewelry design and is identical to the appearance to the wax model 22.

If a manufacturer wants to reproduce the metal jewelry model into a final product, the metal model is used to form a mold 34 as seen in FIGS. 6 and 7. The metal model is placed in a holder, and liquid silicone is poured in the holder (not shown). The silicone cures around the metal model. After the silicone cures, the rubber mold 34 is cut in half (see FIG. 7), and the metal model is removed. A cavity 36 in the exact shape of the metal jewelry model has been formed in the rubber mold 34 and is seen in FIG. 7.

Figure 5:
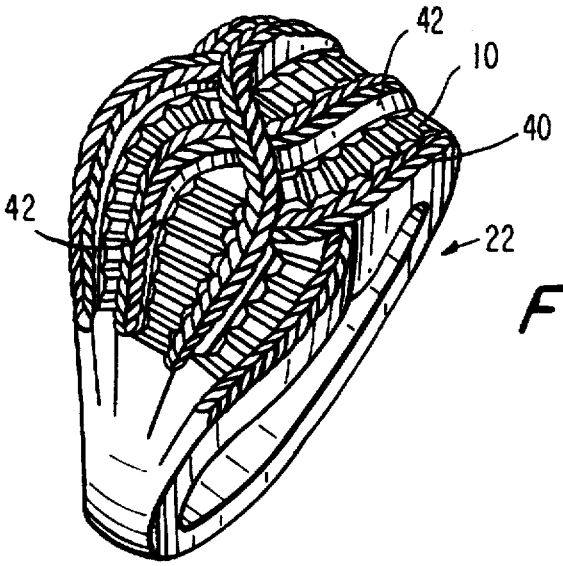
FIG. 5 is a perspective view of a ring formed from the model of FIG. 4 according to this invention with baguettes set between the fragile structure of the rope design by the wax setting process without the need to deform the walls holding the baguettes.

The rubber mold 34 is used to make a casting or reproduction of the metal model. Wax is "shot"0 into the cavity 36 in the rubber mold through a conduit 38, and the wax hardens. The solid wax model 22 is removed from the rubber mold 34. In the present invention, the tapered baguettes or stones 10 are set in the wax model as seen in FIG. 5 without needing thin walls to support the stones 10. This is more particularly seen in FIG. 5 with a rope design 40 formed on top of opposite flat walls 42 with the stones 10 set between opposite surfaces of the ring rope design when in the wax form. The wax is malleable permitting the stones 10 to be set in the wax model.

Figure 8:
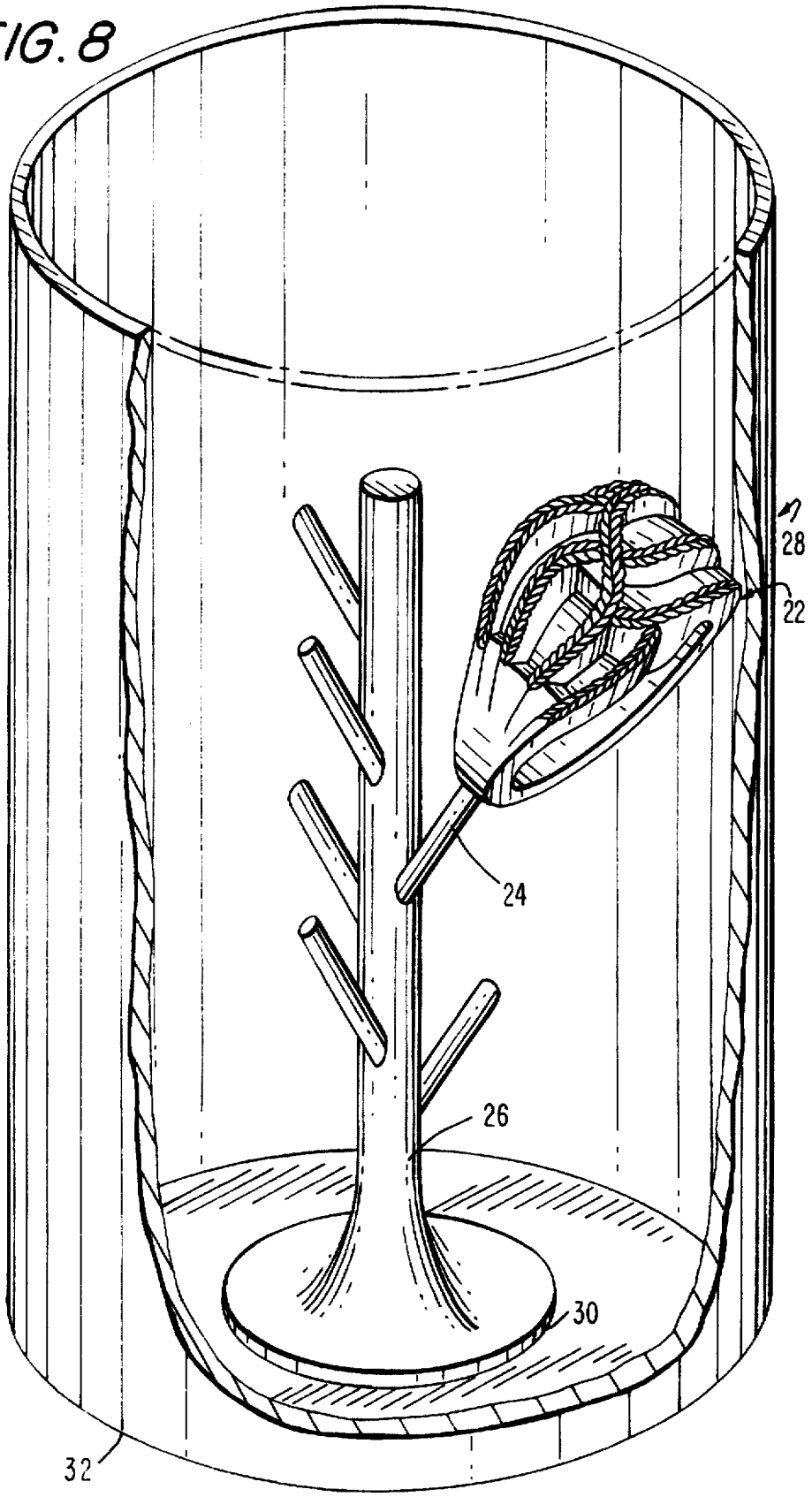
FIG. 8 is a perspective view of a metal cylinder containing a wax model attached to a sprue, and the sprue is attached to a tree used in the lost wax process.

To form the jewelry of FIG. 5 with the stones set in place in the wax model, the lost wax process shown in FIG. 8 is performed. This is the same process described above for forming the metal model except that hot, liquid gold or silver is poured in the hole. The heat of the hot metal melts the wax while the stones 10 remain in place in the plaster of paris as the hot metal fills the cavity.

The liquid wax because of its lower density is forced out by the liquid metal with the stones still held in place as the metal replaces the wax. The metal cools, and as it hardens, the stones are set into the metal. Lastly, the surfaces of the ring are polished, and the process of creating a jewelry piece with precious stones set without hammering utilizing this invention is completed.

This invention has been described with reference to a preferred embodiment and variations thereof are part of this invention when covered by the appended claims.

I claim:

1. An article of jewelry including stones comprising a metal portion and stones attached thereto, said metal portion having observable ornamental surfaces comprising a fragile structure to which said stones are held, said stones set in place fixedly held directly to said ornamental surfaces without deformation of said ornamental surfaces.

2. An article of jewelry as set forth in claim 1, wherein said stones compose a plurality of baguettes set in a row, said baguettes held in place between opposite ornamental surfaces.

3. An article of jewelry as set forth in claim 1, wherein said stones comprise a plurality of lbaguettes set in a row and said stones are set between said ornamental surfaces.

4. An article of jewelry as set forth in claim 1, wherein, said article of jewelry is based on a wax model, said stones set in said wax model prior to said article of jewelry being formed by the lost wax process.

* * * * *